US007635276B1

(12) United States Patent
Chu et al.

(10) Patent No.: US 7,635,276 B1
(45) Date of Patent: Dec. 22, 2009

(54) ELECTRICAL CONNECTOR

(75) Inventors: Ping-Chuan Chu, Hsin-Tien (TW); Jun-Qiang Cui, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/336,533

(22) Filed: Dec. 17, 2008

(30) Foreign Application Priority Data

Aug. 8, 2008 (TW) ..... 97214303 U

(51) Int. Cl.
*H01R 13/62* (2006.01)
*H01R 24/00* (2006.01)

(52) U.S. Cl. ..... 439/326; 439/630

(58) Field of Classification Search ..... 439/607, 439/326, 329, 630
See application file for complete search history.

(56) References Cited

U.S. PATENT DOCUMENTS 6,099,335 A * 8/2000 Chang ..... 439/607
6,149,466 A * 11/2000 Bricaud et al. ..... 439/630
7,014,481 B2 * 3/2006 Miyamoto ..... 439/95
7,220,148 B2 * 5/2007 Zhao et al. ..... 439/630

* cited by examiner

*Primary Examiner*—Briggitte R Hammond
(74) *Attorney, Agent, or Firm*—Pai Patent & Trademark Law Firm; Chao-Chang David Pai

(57) ABSTRACT

An electrical connector has an insulative housing, a plurality of terminals and a metal shell. The insulative housing has a base and an extension. The terminals are mounted in the base. The metal shell covers the insulative housing to define a card space between the insulative housing and the metal shell and has a top plate and two lateral plates. The top plate has a plurality of pressing tabs formed on and protruding from the top plate towards the top of the insulative housing to tightly abut against a card that is inserted into the card space. The pressing tabs prevent the card from moving or falling out of the card space.

3 Claims, 3 Drawing Sheets

ELECTRICAL CONNECTOR

BACKGROUND OF THE INVENTION

1. Field of the Invention

The present invention relates to a connector, and more particularly to an electrical connector that securely holds a Subscriber Identity Module (SIM) card.

2. Description of Related Art

Conventional electrical connectors for holding Subscriber Identity Module (SIM) cards comprise an insulative housing, a plurality of terminals, a metal shell and a detecting assembly. The terminals are mounted on the insulative housing. The metal shell covers the insulative housing and defines a card space between the insulative housing and the metal shell and having an opening. The detecting assembly is mounted in the insulative housing adjacent to or away from the opening of the space. When a SIM card is mounted in the card space, the terminals abut resiliently against and electrically connect to the SIM card. To acquire stable signal transmission, sufficient resilience of the terminals is needed so that the manufacturing cost of the terminals is high. Furthermore, the resilience of the terminals lowers after a long period that the SIM card tightly abuts the terminals so that signal transmission failure easily happens between the SIM card and the electrical connector.

To overcome the shortcomings, the present invention provides an electrical connector to mitigate or obviate the aforementioned problems.

SUMMARY OF THE INVENTION

The main objective of the invention is to provide an electrical connector that securely holds a Subscriber Identity Module (SIM) card.

An electrical connector in accordance with the present invention has an insulative housing, a plurality of terminals and a metal shell. The insulative housing has a base and an extension. The terminals are mounted in the base. The metal shell covers the insulative housing to define a card space between the insulative housing and the metal shell and has a top plate and two lateral plates. The top plate has a plurality of pressing tabs formed on and protruding from the top plate towards the top of the insulative housing to tightly abut against a card that is inserted into the card space. The pressing tabs prevent the card from moving or falling out of the card space.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
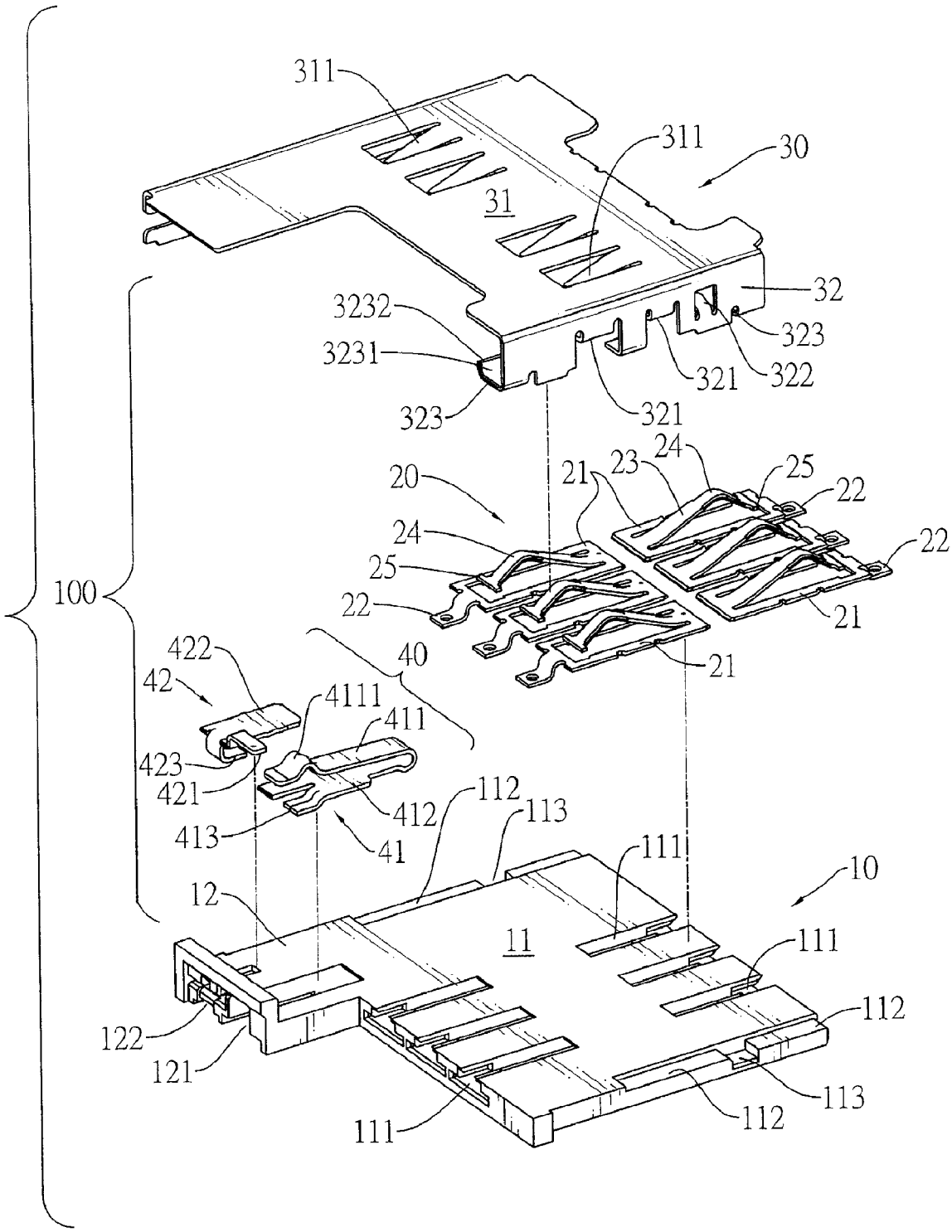
FIG. 1 is an exploded top perspective view of an electrical connector in accordance with the present invention.
Figure 2:
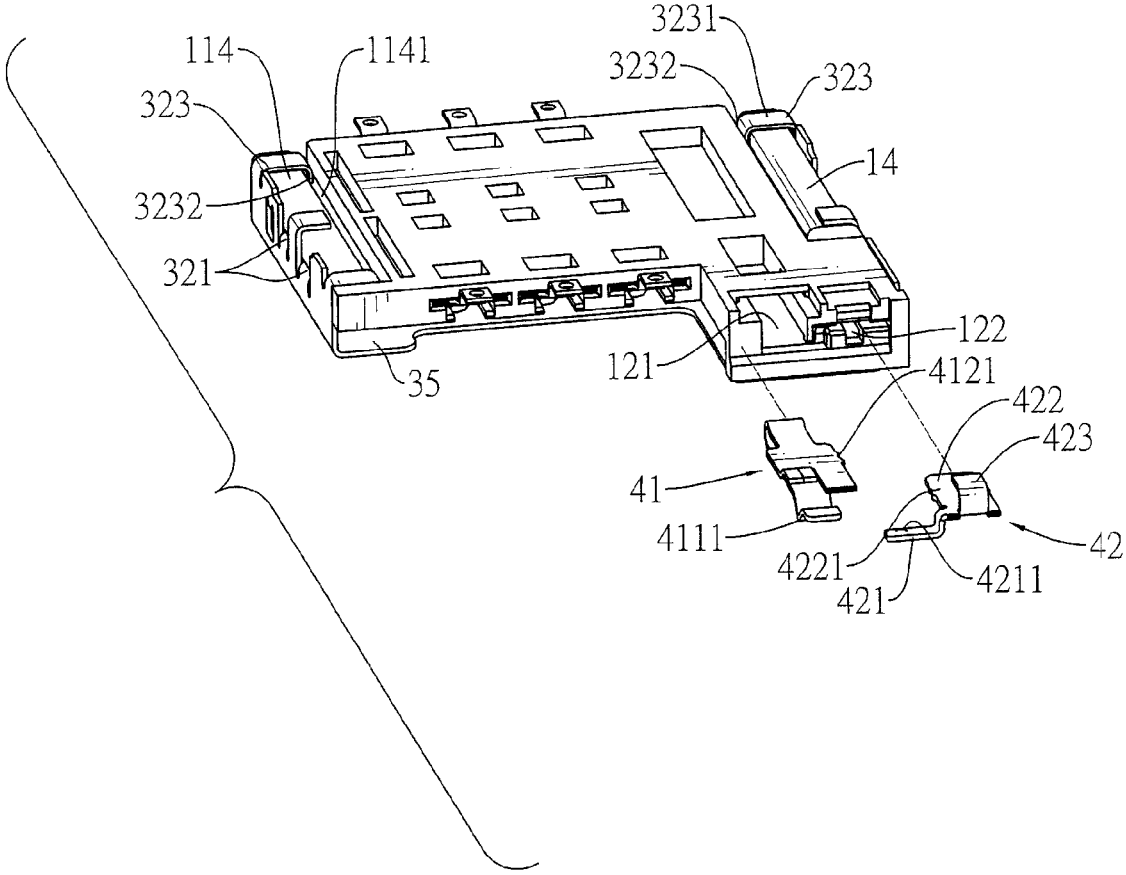
FIG. 2 is a partially exploded bottom perspective view of the electrical connector in FIG. 1.
Figure 3:
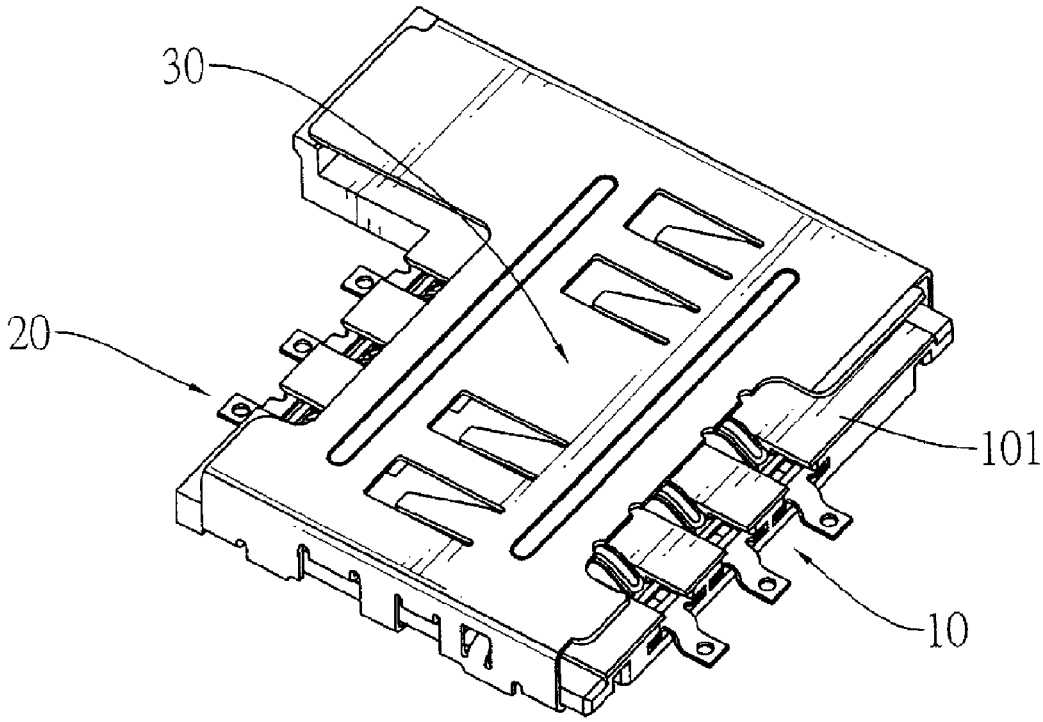
FIG. 3 is a perspective view of the electrical connector in FIG. 1.

With reference to FIGS. 1 to 3, an electrical connector (100) in accordance with the present invention may be mounted on a printed circuit board (PCB) in an electronic device and may hold a Subscriber Identity Module (SIM) card.

The electrical connector (100) comprises an insulative housing (10), a plurality of terminals (20), a metal shell (30) and a detecting assembly (40).

The insulative housing (10) has a base (11) and an extension (12).

The base (11) has a top, a bottom, a front end, a rear end, two opposite sides, two rows of terminal slots (111), two indentations (112), two positioning recesses (113) and two hooking portions (114). The rows are symmetrical to each other and are adjacent respectively to the front end and the rear end. Each terminal slot (111) is defined in the top of the base (11). The indentations (112) are defined in the top adjacent respectively to the sides and each indentation (112) has an inner surface. The positioning recesses (113) are defined respectively in the inner surfaces of the indentations (112). The hooking portions (114) are formed on the bottom adjacent respectively to the sides and each hooking portion (114) has a hooking slit (1141) defined in the bottom and the rear end of the base (11).

The extension (12) is formed on and protrudes forwards from the front end of the base (10) and has a first mounting cavity (121) and a second mounting cavity (122). The first mounting cavity (121) is defined in the extension (12) and has an inner surface. The second mounting cavity (122) is defined in the extension (12) and has an inner surface.

The terminals (20) correspond respectively to and are mounted respectively in the terminal slots (111) and each terminal (20) has a mounting portion (21), a soldering portion (22), a resilient contacting portion (24) and a slide portion (25).

The mounting portion (21) may be rectangular and is mounted securely in a corresponding terminal (20).

The soldering portion (22) is formed on and protrudes from the mounting portion (21).

The resilient contacting portion (23) may be V-shaped, is formed on and protrudes from the mounting portion (21), may contact and connect electrically to a contact of the SIM card to implement signal or power transmission and has a distal end.

The slide portion (25) is formed transversely on the distal end of the resilient contacting portion (23) and is mounted slidably in the corresponding terminal slot (111).

The metal shell (30) covers the insulative housing (10) to define a card space (35) between the metal shell (30) and the insulative housing (10) and having an entrance (101) adjacent to the rear end of the base (11). The metal shell (30) has a top plate (31) and two lateral plates (32).

The top plate (31) is located above the top of the insulative housing (10) and has two opposite side edges and a plurality of pressing tabs (311). The pressing tabs (311) are formed on and protrude from the top plate (31) towards the top of the insulative housing (10), face the resilient contacting portions (24) of the terminals (20) and may abut tightly against a SIM card held in the card space (35). When the SIM card is mounted in the card space (35), the pressing tabs (311) of the metal shell (30) cooperate with the resilient contacting portions (24) of the terminals (20) to securely hold the SIM card.

The lateral plates (32) are formed on and protrude respectively and perpendicularly downwards from the side edges of the top plate (31) and each lateral plate (32) has at least one mounting tab (321), a positioning tab (322) and at least one slide hook (323). The at least one mounting tab (321) is formed on and protrudes substantially perpendicularly from the lateral plate (32) and is mounted in one of indentations (112). The positioning tab (322) is formed on and protrudes substantially perpendicularly from the lateral plate (32) and is mounted in one of the positioning recesses (113) to prevent the metal shell (30) from sliding back and forth relative to the insulative housing (10). The at least one slide hook (323) may be L-shaped, is mounted on the bottom of the base (11) and slidably hooks in the hooking slit (1141) of one of the hooking portions (114) so that the base (11) is held between the at least one mounting tab (321) and the at least one hook (323).

The detecting assembly (40) is mounted on the extension (12) of the insulative housing (10), connects electrically to a circuit on the PCB, is capable of detecting a SIM card inserted into the card space (35) and has a first detecting terminal (41) and a second detecting terminal (42).

The first detecting terminal (41) may be U-shaped, is mounted in the first mounting cavity (121) and has a mounting section (412), a resilient section (411) and a soldering section (413).

The mounting section (412) is mounted securely in the first mounting cavity (121) and has teeth (4121). The teeth (4121) are formed on and protrude from the first detecting terminal (41) and stab into the inner surface of the first mounting cavity (121).

The resilient section (411) is formed on and protrudes from the mounting section (412) and has a contacting section (4111) being V-shaped to contact and connect electrically to a contact of the SIM card.

The soldering section (413) is formed on and protrudes from the mounting section (412) opposite to the resilient section (411) and is soldered on the PCB so that the first detecting terminal (41) connects electrically to the PCB.

The second detecting terminal (42) is mounted in the second mounting cavity (122) and has a mounting section (422), a resilient section (421) and a soldering section (423).

The mounting section (422) is mounted securely in the second mounting cavity (122) and has teeth (4221). The teeth (4221) are formed on and protrude from the second detecting terminal (42) and stab into the inner surface of the second mounting cavity (122).

The resilient section (421) is formed on and protrudes transversely from the mounting section (422) and has a contacting section (4211) to contact and connect electrically to a contact of the SIM card.

The soldering section (423) is formed on and protrudes from the mounting section (422) and is soldered on the PCB so that the second detecting terminal (42) connects electrically to the PCB.

When the SIM card is inserted into the card space (35) of the electrical connector (100) and contacts the first and second detecting terminals (41, 42), the circuit on the PCB is activated to implement the signal and power transmission between the SIM card and the electrical connector (100).

When the electrical connector (100) is assembled, the terminals (20) are mounted respectively in the terminal slots (111) of the insulative housing (10). Then, the first and second terminals (41, 42) are mounted respectively into the first and second mounting cavities (121, 122) of the extension (12). The metal shell (30) is mounted on the insulative housing (10) with the slides hooks (323) sliding into the hooking slits (1141) in the base (11) from the rear end.

The pressing tabs (311) of the metal shell (30) cooperate with the resilient contacting portions (24) of the terminals (20) to securely hold the SIM card. Therefore, the SIM card would not inadvertently move or fall out of the electrically connector (100) to cause signal and power transmission failure.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector comprising:

an insulative housing a base having a top, a bottom, a front end, a rear end and two opposite sides and further having two rows of terminal slots defined in the top of the base;

two indentations defined in the top respectively adjacent to the sides and each indentation having an inner surface;

two positioning recesses defined respectively in the inner surfaces of the indentations; and two hooking portions formed on the bottom respectively adjacent to the sides and each hooking portion having a hooking slit defined in the bottom and the rear end of the base; and an extension formed on and protruding forwards from the front end of the base;

a plurality of terminals corresponding respectively to and mounted respectively in the terminal slots; and a metal shell covering the insulative housing to define a card space between the metal shell and the insulative housing and having a top plate located above the top of the insulative housing and having two opposite side edges and a plurality of pressing tabs formed on and protruding from the top plate towards the top of the insulative housing; and two lateral plates formed on and protruding respectively and perpendicularly downwards from the side edges of the top plate, each lateral plate having at least one mounting tab formed on and protruding substantially perpendicularly from the lateral plate and mounted in one of the indentations;

a positioning tab formed on and protruding substantially perpendicularly from the lateral plate and mounted in one of the positioning recesses; and at least one slide hook mounted on the bottom of the base and slidably hooking in the hooking slit of one of the hooking portions.

2. The electrical connector as claimed in claim 1, wherein each terminal has a mounting portion mounted securely in a corresponding terminal slot;

a soldering portion formed on and protruding from the mounting portion;

a resilient contacting portion formed on and protruding from the mounting portion and having a distal end; and a slide portion formed transversely on the distal end of the resilient contacting portion and mounted slidably in the corresponding terminal slot; and the pressing tabs of the metal shell face the resilient contacting portions of the terminals.

3. The electrical connector as claimed in claim 2, wherein the extension of the insulative housing further has a first mounting cavity defined in the extension and having an inner surface; and a second mounting cavity defined in the extension and having an inner surface; and a detecting assembly is mounted on the extension of the insulative housing and has a first detecting terminal mounted in the first mounting cavity and having a mounting section mounted securely in the first mounting cavity and having teeth formed on and protruding from the first detecting terminal and stabbing into the inner surface of the first mounting cavity;

a resilient section formed on and protruding from the mounting section and having a contacting section; and a soldering section formed on and protruding from the mounting section opposite to the resilient section; and a second detecting terminal mounted in the second mounting cavity and having a mounting section mounted securely in the second mounting cavity and having teeth formed on and protruding from the second detecting terminal and stabbing into the inner surface of the second mounting cavity;

a resilient section formed on and protruding transversely from the mounting section of the second detecting terminal and having a contacting section; and a soldering section formed on and protruding from the mounting section of the second detecting terminal.

* * * * *